US005832995A

United States Patent [19]

Chiang et al.

[11] Patent Number: 5,832,995

[45] Date of Patent: Nov. 10, 1998

[54] HEAT TRANSFER TUBE

[75] Inventors: Robert H. L. Chiang, Manlius; Jack L. Esformes, N. Syracuse, both of N.Y.

[73] Assignee: Carrier Corporation, Syracuse, N.Y.

[21] Appl. No.: 497,968

[22] Filed: Jul. 3, 1995

Related U.S. Application Data

[63] Continuation-in-part of Ser. No. 304,295, Sep. 12, 1994, abandoned.

[51] Int. Cl.[6] ..... F28F 19/00

[52] U.S. Cl. ..... 165/179; 165/184

[58] Field of Search ..... 165/133, 179, 165/184

[56] References Cited

U.S. PATENT DOCUMENTS 4,438,807 3/1984 Mathur et al. ..... 165/133

5,203,404 4/1993 Chiang et al. ..... 165/133

*Primary Examiner*—John Fox

[57] ABSTRACT

An improved heat transfer tube for use in air conditioning chillers of the shell and tube type. The tube (10) achieves objectives of improved manufacturability, heat transfer performance and fluid flow characteristics by having external helical fins (12) with specified ranges of fin heights and fin density for a specified range of tube outer diameters.

12 Claims, 2 Drawing Sheets

HEAT TRANSFER TUBE

This application is a continuation-in-part of application Ser. No. 08/304,295, filed 12 Sep., 1994, now abandoned.

BACKGROUND OF THE INVENTION

The present invention relates generally to heat transfer tubes. In particular, the invention relates to a heat transfer tube that is optimized for use in an application in which heat transfers between a fluid flowing through the tube and a fluid in which the tube is submerged.

Many air conditioning systems contain shell and tube type heat exchangers. In a shell and tube heat exchanger there are a plurality of tubes contained within a single shell. The tubes are customarily arranged to provide a multiplicity of parallel flow paths through the heat exchanger for a fluid to be cooled. A common type of shell and tube heat exchanger is an air conditioning water chiller. In a water chiller, the water flows through the tubes. The tubes are immersed in a refrigerant that flows through the heat exchanger shell. The water is cooled by heat transfer through the walls of the tubes. The transferred heat vaporizes the refrigerant in contact with the exterior surface of the tubes.

For efficiency, economy and equipment weight and volume reduction, designers of air conditioning systems strive to maximize the heat transfer performance of the heat exchangers in the system and to minimize fluid flow losses. The heat transfer performance of a shell and tube chiller is largely determined by the heat transfer characteristics of the individual tubes within it. The flow losses through a tube depend on the configuration of the internal surface and on the internal cross sectional area of the tube. The internal cross sectional area in turn depends on the internal diameter.

Increasing surface area can improve a tube's heat transfer performance. The external surface area can be increased by finning. Air conditioning chiller tubes are generally made of copper or a copper alloy and have an outside diameter in the range of 11.4 to 26.9 mm (0.45 to 1.06 in.). Fins can be formed on the exterior of the tube by working the metal of the tube wall, such as described in commonly assigned U.S. Pat. No. 4,438,807. The fins in copper chiller tubes are generally formed as helices in one or more fin convolutions or "starts." In general, the higher the fins, the better the heat transfer performance. But higher fins use more material from the tube wall. Because the wall thickness of the tube must be sufficient to provide adequate burst strength, there is a maximum height of the fins that can be formed on a tube of a given initial wall thickness. Another way of increasing external surface area in a finned tube is by increasing the fin density, that is, the number of fins per tube unit length. But for reasons that are analogous to the limitation on fin height, for a given initial wall thickness there is a maximum fin density if adequate burst strength is to be maintained in the tube wall. Manufacturability considerations also dictate practical limits on fin height and density since forming very high fins and having a very high fin density on a chiller tube can result in excessive loads on the tools used to form the fins.

The internal configuration of a tube also has an effect on its heat transfer performance. Internal ribs increase the area of the interior surface of the tube exposed to the fluid in the tube, thus improving heat transfer performance. The internal configuration can also create flow conditions within the tube that have an effect on the rate of heat transfer between the fluid and the tube wall. In copper or copper alloy air conditioning chiller tubes, internal enhancements to improve heat transfer performance, such as ribs, are formed from the metal in the wall of the tube. As is analogous to the case with external enhancements, the height and density of the ribs must not be so great as to result in a wall of insufficient burst strength. In addition, an internal surface enhancement must not excessively raise the fluid flow resistance of the tube. Since flow resistance is in large measure dependent on internal tube cross sectional area, from a flow resistance point of view it is important that the tube internal diameter be as large as possible.

SUMMARY OF THE INVENTION

The present invention is a heat transfer tube having an external surface enhancement having finished dimensions that optimize, for its nominal finished outer dimension, its manufacturability, heat transfer performance and internal fluid flow characteristics. This optimization is achieved by specifying the fin height, fin density and tube outer diameter in accordance with teachings of this invention. Since, to obtain a given burst strength in a tube of a given outer diameter and made of a given material the tube wall must be of a given minimum thickness, it follows that specifying the outer diameter, fin height and fin density also indirectly determines the maximum allowable inner tube diameter. More specifically, it has been determined that for best results overall tube heat transfer performance and/or lower pressure losses within the tube may be obtained in tubes having a very high fin density with a fin height within a defined range directly proportional to the fin density but less than the height which conventional wisdom might lead one to choose.

DESCRIPTION OF THE PREFERRED EMBODIMENT

Figure 1:
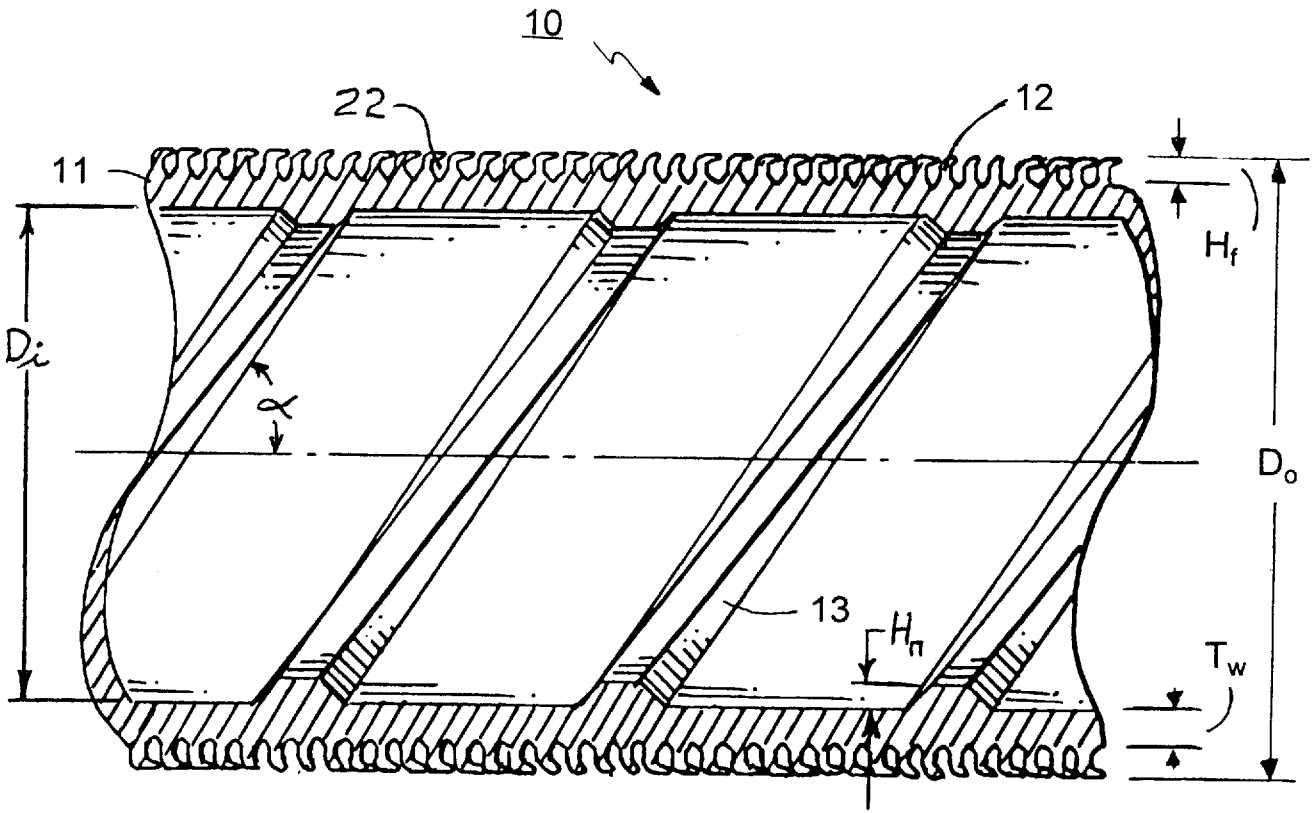
FIG. 1 is a sectional view, taken through the longitudinal axis, of a heat transfer tube made according to the teachings of the present invention.

FIG. 1 shows heat transfer tube 10 of the present invention having an outer diameter $D_o$ and inner diameter $D_i$. Tube 10 has tube wall 11, external helical fins 12 and, internal helical ribs 13. As shown in the drawing, the fins 12 are substantially uniform over the full length of the tube 10. The thickness of wall 11 is $T_w$, which excludes the height of the fins 12 and ribs 13. The height of the fins 12 is $H_f$ and the height of the ribs 13 is $H_r$. Fin density $D_f$ is the number of fins 12 per unit length of tube. The tube 10 has at least one helical fin convolution. The exemplary tube shown in the drawing has the fin tips bent over or flattened to form a plurality of helical cavities 22 around the tube circumference between adjacent fins. The cavities improve boiling heat transfer performance and is a well known feature of prior art tubes.

It is well known that tube stocks used for chiller and similar heat transfer applications have thicknesses selected within the range of 10 mm to 14 mm, and most typically between 11.4 mm and 12.7 mm. The finished tubes typically have a final nominal wall thickness $T_w$ of between 0.64 mm and 0.89 mm, with the most typical being at the low end (i.e. 0.64 mm).

To achieve the objectives of manufacturability, heat transfer performance and fluid flow characteristics in a tube intended for use in an air conditioning system heat exchanger, or chiller, of the shell and tube type and having a tube outer diameter ($D_o$) of between 11.4 and 26.9 mm (0.45 and 1.05 inch), the fin height should be between 0.4 and 0.64 mm (0.016 to 0.025 inch), and the fin density should be between 21 and 39 fins per cm (53–99 fins per inch).

Figure 2:
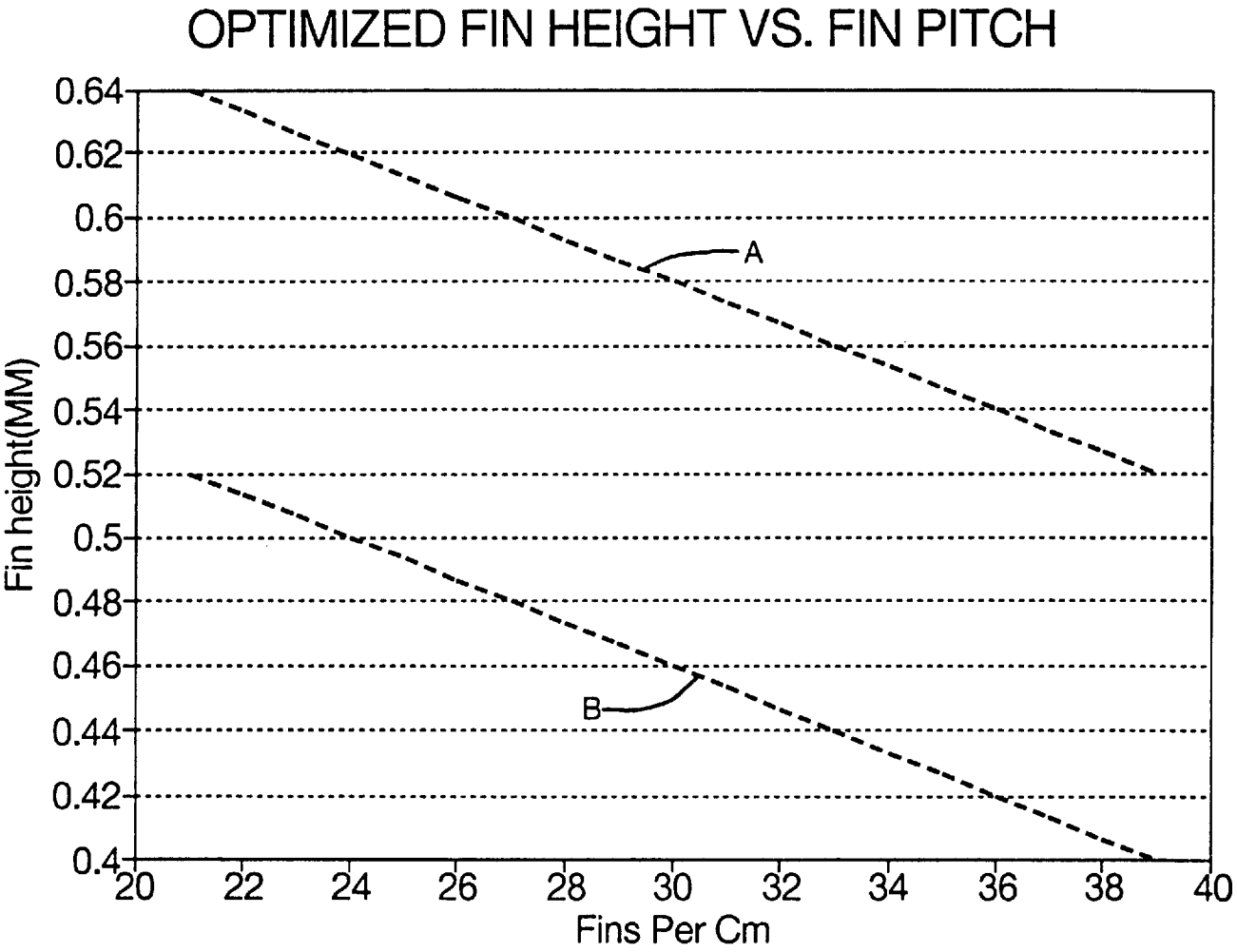
FIG. 2 is a graph showing the preferred relationship of fin density to fin height according to the present invention.

Preferably, fin height and fin density (or pitch) should be selected using the graph of FIG. 2. Points on the graph between the dashed lines A and B give optimum results. For example, if 30 fins per centimeter is used, the fin height should be selected from between approximately 0.46 mm and 0.58 mm. The preferred fin height may also be calculated using the following formula:

$$H_f = (0.72 \pm 0.06) - \frac{D_f}{150}$$

where $H_f$ is in millimeters and $D_f$ is in fins per centimeter.

We have tested a copper tube (conforming to ASME SB-359) configured according to the teachings of the present invention. The dimensions of the tube were:

| TUBE A | |
|---|---|
| Outer Diameter ($D_o$) | 18.80 mm (0.740 inch) |
| External Fin density ($D_f$) | 21.7 fins per cm (55 fins per inch) |
| External Fin height ($H_f$) | 0.6 mm (0.0235 inch) |
| Wall thickness ($T_w$) | 0.64 mm (0.025 inch) |
| Inner diameter ($D_i$) | 16.33 mm (0.643 inch) |
| Internal Rib Height ($H_r$) | 0.46 mm (0.018 in.) |
| Internal Rib density | 45 starts/circum. |
| Internal helix angle ($\alpha$) | 45 degrees |

For comparison purposes we tested a prior art tube having the same outer diameter and wall thickness as Tube A. The dimensions of that tube were:

| TUBE B | |
|---|---|
| Outer Diameter ($D_o$) | 18.80 mm (0.740 inch) |
| External Fin density ($D_f$ | 19.3 fins per cm (49 fins per inch) |
| External Fin height ($H_f$) | 0.74 mm (0.029 inch) |
| Wall thickness ($T_w$) | 0.64 mm (0.025 inch) |
| Inner diameter ($D_i$) | 16.05 mm (0.632 inch) |
| Internal Rib Height ($H_r$) | 0.38 mm (0.015 in.) |
| Internal Rib density | 38 starts/circum. |
| Internal helix angle ($\alpha$) | 49 degrees |

Both tests were of a refrigerant evaporating application in which water was the fluid inside the tube and refrigerant R 134a was the fluid on the exterior of the tube. The water flow rate was 26.5 liters/hr (7 gallons/hr) throughout the tests. We varied the heat flux from 817.5 kjoules/hr/cm$^2$ (5000 Btu/hr/ft$^2$) to 1798.5 kjoules/hr/cm$^2$ (11,000 Btu/hr/ft$^2$).

The tube-to-refrigerant heat transfer performance of Tube A was superior to the tube-to-refrigerant heat transfer performance of Tube B over the entire range of heat fluxes with the performance index (heat transfer performance of Tube A divided by the heat transfer performance of Tube B) ranging from 1.015 at 817.5 kjoules/hr/cm$^2$ (5000 Btu/hr/ft$^2$) to 1.085 at 1798.5 kjoules/hr/cm$^2$ (11,000 Btu/hr/ft$^2$). Also, the water pressure loss through the Tube A of the present invention was 0.95 of the pressure loss through the prior art Tube B.

The prior art tube (Tube B) was designed using the conventional wisdom of making the fins as high as possible for maximum surface area. In the example, the Tube B fin height was 0.74 mm as compared to a height of 0.60 mm for Tube A designed according to the present invention. Tube B had 19 fins per centimeter of length, about 12.5% fewer fins than Tube A.

The selection of fin density and fin height in accordance with the present invention resulted in an increased internal diameter (16.33 mm compared to 16.05 mm) for tubes of the same external diameter made from the same thickness tube stock and having the same final wall thickness $T_w$. This allowed use of a more aggressive internal rib geometry on Tube A (i.e. higher and more ribs) while still retaining a significant improvement in pressure loss (a 5% drop) over Tube B. The more aggressive internal geometry coupled with the higher fin density and lower fin height produced a heat transfer performance improvement as much as 8% over Tube B.

If desired, the improvement provided by the present invention in the comparison above could have been taken entirely as a benefit in pressure loss reduction. For example, if Tubes A and B were both made with smooth internal surfaces (all other dimensions being unchanged), it is estimated that Tube A would have had a pressure loss about 0.90 of the pressure loss of Tube B.

We claim:

1. An improved heat transfer tube (10) made of copper or copper alloy and having at least one external helical fin (12) and a tube outer diameter ($D_o$) of between 11.4 and 26.9 mm (0.45 and 1.06 inch), in which the improvement comprises:

the fin density ($D_f$) being between 21 and 39 fins per centimeter (53–99 fins per inch); and wherein the fin height ($H_f$) in millimeters lies in an area between the lines defined by the upper and lower limits of the expression $$H_f = (0.72 \pm 0.06) - \frac{D_f}{150}$$

where $D_f$ is expressed in fins per centimeter.

2. The tube of claim 1 in which said tube outer diameter is 18.80 millimeters (0.74 inch), said fin height is 0.60 millimeter (0.0235 inch) and said fin density is 21.7 fins per centimeter (55 fins per inch).

3. The tube of claim 2, wherein the nominal tube wall thickness ($T_w$) is 0.64 mm, and the tube includes at least one internal helical rib (13).

4. The tube of claim 1 including at least one internal helical rib (13).

5. The tube of claim 4, wherein the nominal tube wall thickness ($T_w$) is between 0.64 mm and 0.89 mm.

6. The tube of claim 4, wherein the nominal tube wall thickness ($T_w$) is 0.64 mm.

7. The tube of claim 4 where adjacent fins (12) define helical cavities (22) around the tube circumference.

8. The tube of claim 1 including at least one internal helical rib (13) and adjacent fins (12) define helical cavities (22) around the tube circumference.

9. A heat transfer tube (10) made of copper or a copper alloy having at least one external helical fin (12), a tube outer diameter selected from between 11.4 mm and 26.9 mm, a fin density ($D_f$) selected from between 21 and 39 fins per centimeter, and a fin height ($H_f$), in millimeters, which lies in an area between the lines defined by the upper and lower limits of the expression $$(0.72 \pm 0.06) - \frac{D_f}{150},$$

wherein the fins are substantially uniform over the full length of said tube.

10. The tube of claim 9, including at least one internal helical rib (13) over the full length of said tube.

11. The tube of claim 10, wherein the fin density is 21.7 fins per centimeter, and the fin height is 0.60 millimeters.

12. The tube of claim 11 wherein the nominal wall thickness ($T_w$) is 0.64 millimeters.

* * * * *